US007163496B1

(12) United States Patent
Trotter

(10) Patent No.: US 7,163,496 B1
(45) Date of Patent: Jan. 16, 2007

(54) HAMMER CURL CABLE PULL EXERCISE BAR

(76) Inventor: Ray Trotter, 1257 N. Volutsia, Wichita, KS (US) 67214

( * ) Notice: Subject to any disclaimer, the term of this patent is extended or adjusted under 35 U.S.C. 154(b) by 601 days.

(21) Appl. No.: 10/422,104

(22) Filed: Apr. 24, 2003

(51) Int. Cl.
*A63B 21/00* (2006.01)

(52) U.S. Cl. ..... 482/126; 482/139; 482/100

(58) Field of Classification Search ..... 482/139, 482/100, 101, 130, 121–129, 117, 118, 99, 482/907, 104–108
See application file for complete search history.

(56) References Cited

U.S. PATENT DOCUMENTS

| | | | | | |
|---|---|---|---|---|---|
| D46,629 | S | * | 11/1914 | Daniels | D21/694 |
| 3,850,431 | A | | 11/1974 | Winans | |
| D262,814 | S | | 1/1982 | Lambert et al. | |
| D262,815 | S | * | 1/1982 | Lambert et al. | D21/694 |
| 4,623,146 | A | | 11/1986 | Jackson | |
| 4,852,873 | A | | 8/1989 | O'Donnell et al. | |
| 4,949,956 | A | | 8/1990 | Pobran | |
| D317,032 | S | | 5/1991 | Eckler | |
| D324,894 | S | | 3/1992 | Porcello | |
| 5,273,509 | A | * | 12/1993 | Vittone | 482/139 |
| 5,730,689 | A | * | 3/1998 | Haugen | 482/139 |
| 5,868,651 | A | | 2/1999 | Washington | |
| 5,897,471 | A | | 4/1999 | Multanen et al. | |
| 6,022,302 | A | | 2/2000 | McBride | |
| 6,988,977 | B1 | * | 1/2006 | Webber et al. | 482/100 |

OTHER PUBLICATIONS

Tuff Stuff Jan. 2000 Task industries 1325 E.Frankilin Ave Pomona Ca 91766 Triceep rope Multi-purpose V-Bar.*

* cited by examiner

*Primary Examiner*—Jerome Donnelly
(74) *Attorney, Agent, or Firm*—Kenneth H. Jack; Davis & Jack, LLC

(57) ABSTRACT

A cable pull exercise bar consisting of a hammer curl handle pair, each handle among the hammer curl handle pair having a base end and having a pulling end, the handle pair defining a head clearance space which opens at the handles' base ends; a cross beam spanning between and rigidly interconnecting the handles' pulling ends; and a cable pull hook eye fixedly attached to the cross beam.

12 Claims, 7 Drawing Sheets

HAMMER CURL CABLE PULL EXERCISE BAR

FIELD OF THE INVENTION

This invention relates to exercise equipment for use with cable pull exercise machines. More particularly, this invention relates to manually graspable pull handles which are attachable to cables of such machines.

BACKGROUND OF THE INVENTION

Cable pull exercise bars are commonly configured to facilitate exercise motions which are similar to those facilitated by commonly known free weight exercise bars. For example, the inversely angled hand grip sections of a free weight bicep curl bar are commonly identically reflected upon cable pull bars as inversely angled hand grip sections. However, where a free weight double hammer curl bar is adapted for cable pull work, typically by centrally welding a hook eye to a cross member, the base end cross member of such bar tends to interfere with performance of overhead double hammer curls, the lower cross bar undesirably contacting the exerciser's head upon repetitive hammer curling motion.

Another problem associated with commonly configured cable pull exercise bars is that different types of cable pull exercise bars are needed for performance of varying exercise motions. Duplication of cable pull exercise bars needed for facilitating varying exercise motions results in excess bulk of multiple bars utilized by an exerciser during an exercise session, loss or misplacement of exercise bars, excess materials cost, and lack of cost economies.

The instant inventive hammer curl cable pull exercise bar solves or ameliorates problems noted above by providing a cable pull exercise bar which facilitates double overhead hammer curl exercising motions without head contacting interference, and which is economically and compactly reconfigurable for facilitating varying cable pull exercise motions.

BRIEF SUMMARY OF THE INVENTION

A major structural component of the instant inventive cable pull exercise bar comprises a hammer curl handle pair, the handles of such pair having pulling ends and base ends, the pulling ends of such handles preferably being rigidly interconnected by a cross beam. Preferably, the handles in combination with the cross beam form a "U" bar, the cross beam preferably holding the handles in the parallel alignment which is necessary for facilitating double hammer curl exercising motions. Also preferably, such cross beam orients the handles eight inches to twelve inches apart. Suitably, the cross beam which interconnects the pulling ends of the handles may be alternately configured as a "V" bar or as a straight bar.

A cable attaching means is preferably fixedly attached to the cross beam at its midpoint, such means preferably comprising a hook eye. Alternately, such means may comprise a hook. Numerous other commonly known means for attaching flexible cables to objects may be suitably substituted for the preferred hook eye.

Where the inventive cable pull exercise bar is configured as described above, the handles advantageously define a head clearance space which opens at the base ends of the handle. In use of the inventive cable pull exercise bar, configured as described above and assuming that the exerciser attaches the bar to a cable pull exercise machine for performing double overhead hammer curl exercise motions, the exerciser raises the bar against cable weight resistance to shoulder level, holding the handles of such bar in either hand. Thereafter, the exerciser commences repeatedly performing overhead hammer curling exercising motions typically facing away from the machine, the base ends of the handles pointing substantially upward, and the hook eye of the bar pointing substantially downward toward a low pulley of the weight machine. Upon executing such repeated double overhead hammer curling exercise motions, the exerciser's head, or portions of the exerciser's head may pass through the head clearance space defined by the bar's handles without injury or interference.

For prevention of hand slippage, it is preferred that the handles of the above described cable pull exercise bar have a friction enhancing knurled or ridged surface. Also preferably, hand sliding stops are fixedly, and preferably removably, attached to the base ends of the handles of the bar. Means for attaching the slide stops to the handles preferably comprise helically threaded lug and aperture combinations. Suitably, the stops may be attached by sheer pin locked lug and sleeve joints. Also suitably, quick disconnect couplings may be utilized for interconnecting the hand stops and the handles. Also suitably, though less desirably, the hand stops may be formed wholly with the handles or may be fixedly attached by means of heat fusion welding.

Where the hand stop attaching means comprise the preferred helically threaded lug and aperture combinations, the hand stops and such attaching means advantageously further function for attachment of an exercise cross bar for performing double handed or single handed straight bar bicep curls.

Accordingly, it is an object of the instant invention to provide a cable pull exercise bar which is capable of facilitating double overhead hammer curling exercise motions in conjunction with a cable pull exercise machine, and without head inference.

It is a further object of the instant invention to provide such an exercise bar which is further capable of economical and compact configuration and reconfiguration for performance of varying cable pull exercising motions.

Other and further objects, benefits, and advantages of the present invention will become known to those skilled in the art upon review of the Detailed Description which follows, and upon review of the appended drawings.

DETAILED DESCRIPTION OF PREFERRED EMBODIMENTS

Figure 1:
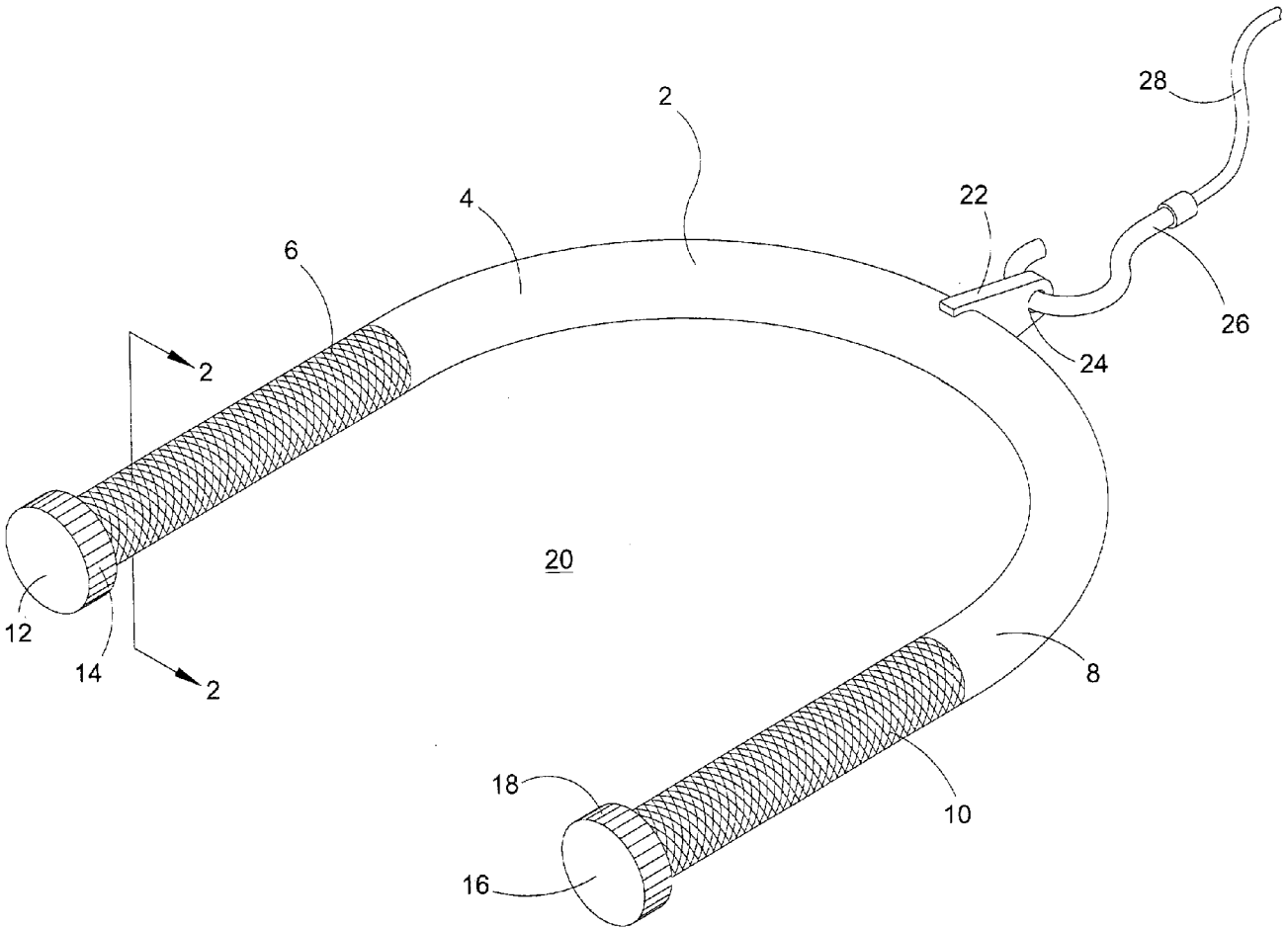
FIG. 1 is an isometric view of the instant inventive cable pull exercise bar.

Referring now to the drawings, and in particular to FIG. 1, the instant inventive hammer curl cable pull exercise bar has a pair of substantially parallel handles 4 and 8. The pulling ends of handles 4 and 8 are rigidly interconnected by a preferably "U" shaped cross beam section 2. Handles 4 and 8 preferably respectively have knurled hand grip sections 6 and 10 for prevention of hand slippage. In order to further prevent hand slippage, hand slide stops 12 and 16 are preferably fixedly attached to the base ends of handles 4 and 8.

Referring further to FIG. 1, in order to effectively attach the inventive cable pull exercise bar to an exercise machine, an attachment plate 22 having a hook eye 24 is preferably fixedly welded to the midpoint of the cross beam 2, the hook eye 24 receiving a hook 26 attached to an end of a cable 28 extending to a cable weight machine (not depicted).

Referring further to FIG. 1, the handles 4 and 8 define a head clearance space 20, such space opening at the base ends of said handles. In use of the inventive cable pull exercise bar configured as depicted in FIG. 1, for performing overhead double hammer curls resisted by a cable weight machine, an exerciser grasps knurled hand grip sections 6 and 10 of handles 4 and 8. Upon executing overhead hammer curling exercising motions while so grasping the bar, the crown or back of the exerciser's head may conveniently pass through space 20 without injury or interference.

Figure 2:
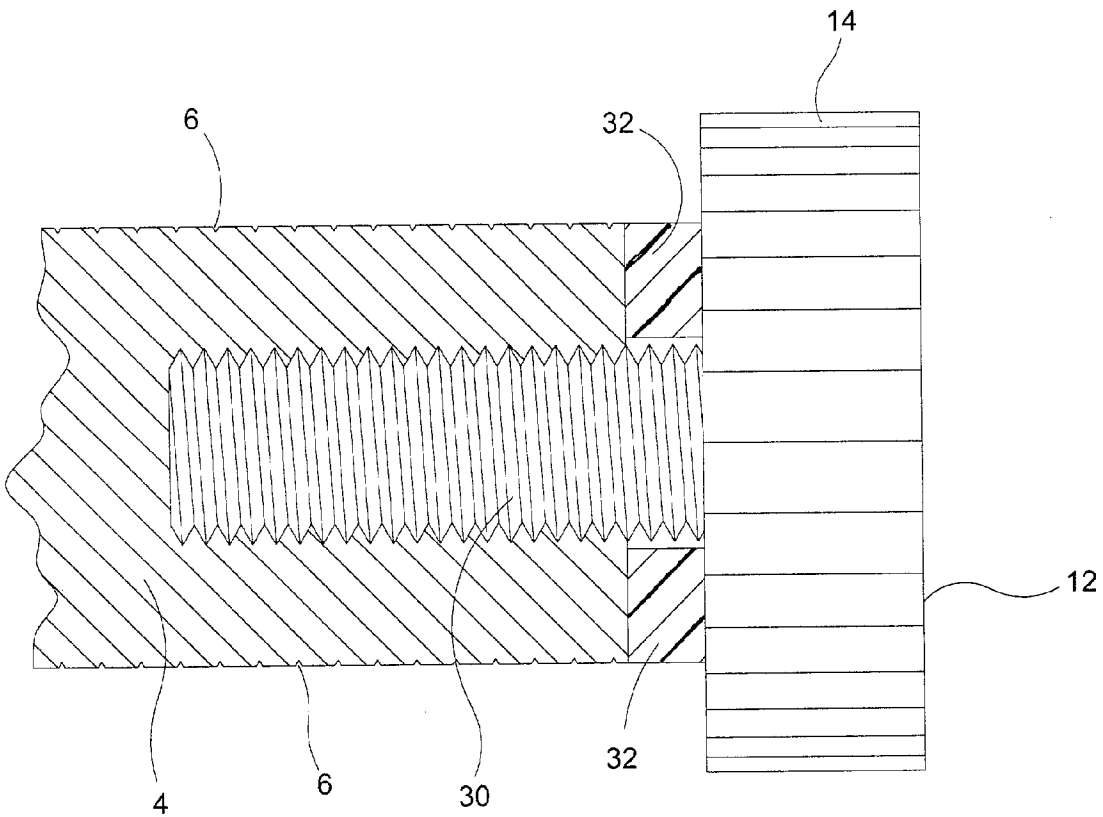
FIG. 2 is a partial sectional view, as indicated in FIG. 1.
Figure 4:
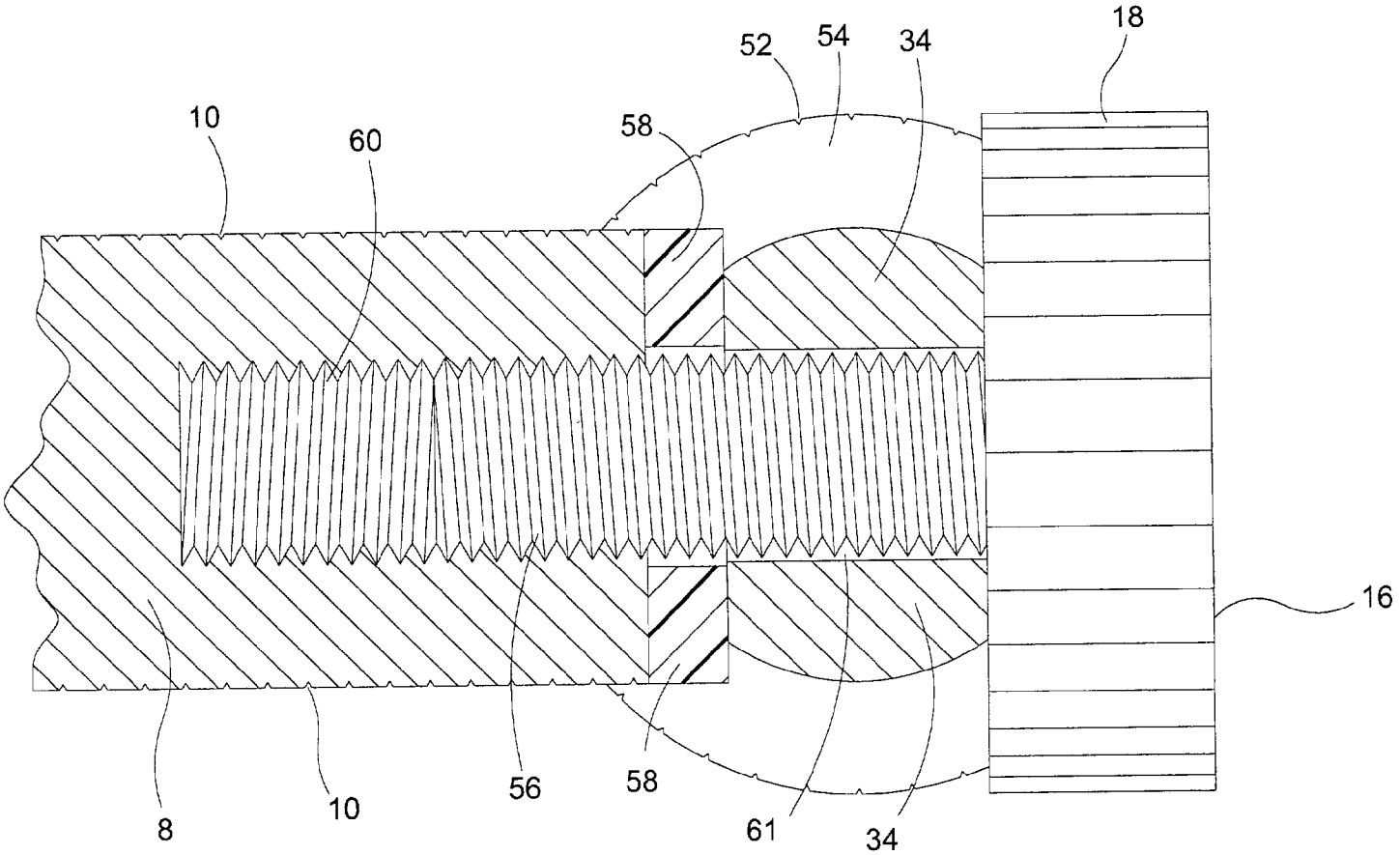
FIG. 4 is a partial sectional view, as indicated in FIG. 3.

Referring simultaneously to FIGS. 1, 2, and 4 hand stops 12 and 16 are preferably removably and fixedly attached to the base ends of handles 4 and 8 by helically threaded lugs represented by lugs 30 and 56. Such lugs preferably are formed wholly with hand stops 12 and 16, and such lugs being mounted threadedly within, referring further to FIG. 4, a helically threaded apertures represented by cavity 60, such apertures extending into the base ends of handles 4 and 6. Preferably, rubber washers represented by washers 32 and 58 are disposed between stops 12 and 16 and the base end of handles 4 and 6. Also preferably, the annular outer surfaces of stops 12 and 16 have multiplicities of friction enhancing ridges 14 and 18 for assistance with stop turning for lug loosening and tightening.

Referring simultaneously to FIGS. 1–4, counter-clockwise rotations of hand stops 12 and 16 withdraw helically threaded lugs 30 and 56 from their helically threaded apertures, represented by cavity 60, within the base ends of handles 4 and 8. Upon completion of withdrawals of hand stops 12 and 16, lugs 30 and 56 may be extended through apertures 61, represented by channel which extend perpendicularly through cross bar 34. Thereafter, rubber washers 32 and 58 may be respectively placed over the ends of lugs 30 and 56 which protrude from said cross bar apertures. Thereafter, the ends of lugs 30 and 56 may be aligned with helically threaded apertures, represented by cavity 60, within the base ends of handles 4 and 8. Thereafter, clockwise rotations of hand stops 12 and 16 draw lugs 30 and 56 into said apertures, sandwiching the cross bar 34 and washers 32 and 58 between hand stops 16 and 12, and the base ends of handles 4 and 8. Upon completion of such clockwise rotation cross bar 34 is securely mounted upon and across said base ends. Preferably, lands 36 and 38 are milled into cross bar 34 at opposite ends of apertures 61 for stable seating of hand stops 16 and 12 and the base ends of handles 4 and 8.

Figure 3:
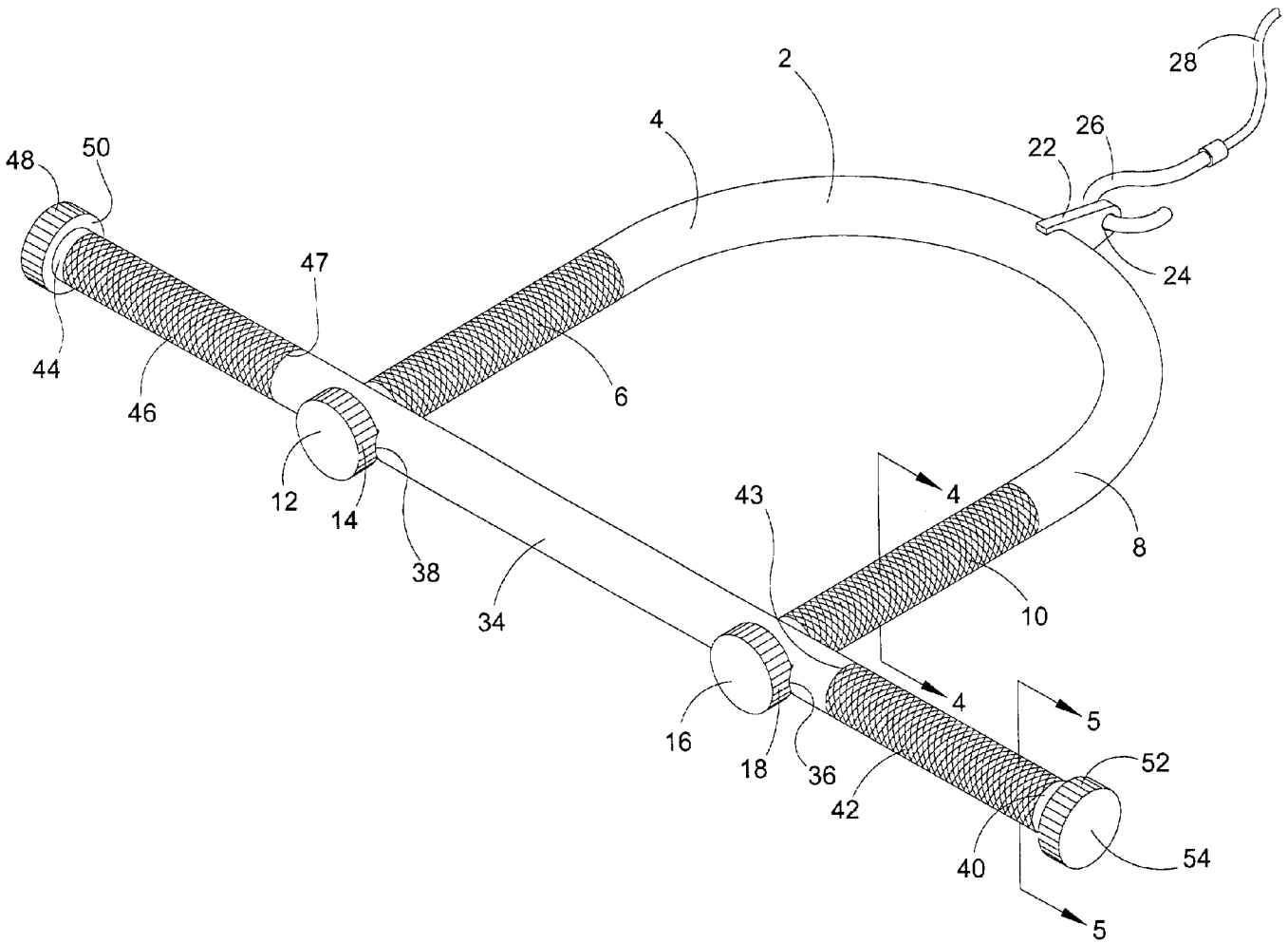
FIG. 3 is an isometric view of an alternate configuration of the cable pull exercise bar depicted in FIG. 1.
Figure 5:
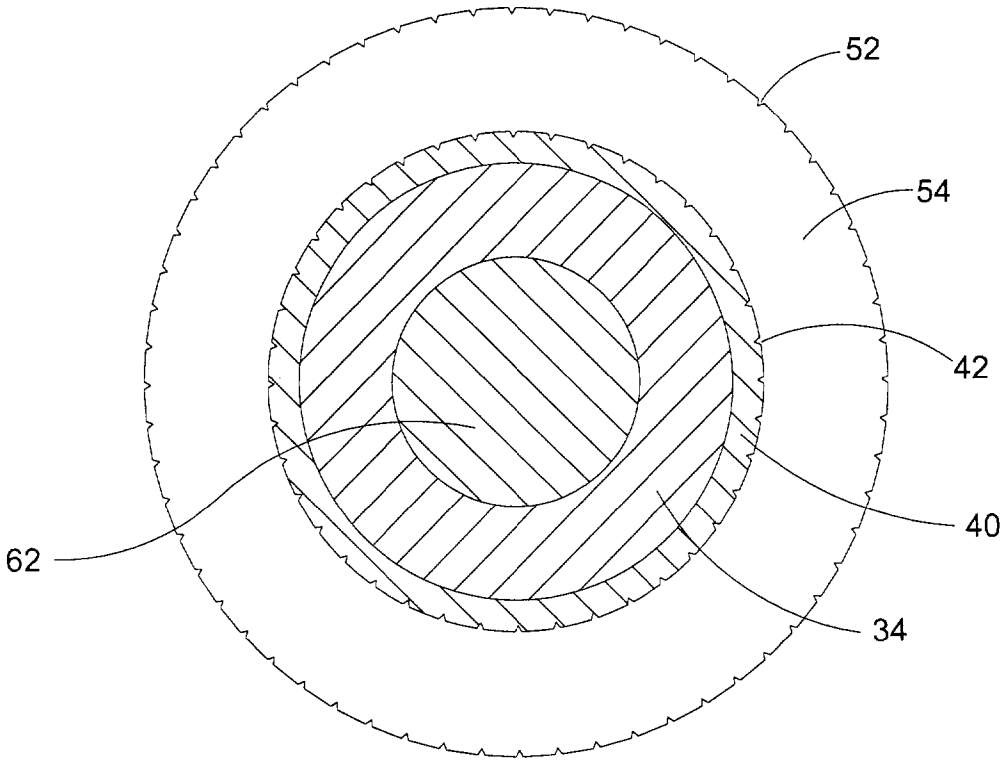
FIG. 5 is an alternate sectional view, as indicated in FIG. 3.

Referring simultaneously to FIGS. 3 and 5, the hand grip sections of cross bar 34 preferably comprise rotatable sleeves 40 and 44, each such sleeve preferably having friction enhancing knurling 42 and 46. Rotatable sleeves 40 and 44 are preferably mounted upon annularly coffered left and right ends of cross bar 34, annular seams 47 and 43 between bar 34 and rotatable sleeves 40 and 44 coinciding with left and right annular coffered steps. Referring further simultaneously to FIGS. 2 and 4, hand stops 50 and 54 are preferably configured substantially identically with hand stops 12 and 18, hand stops 50 and 54 having peripheral friction enhancing ridges 48 and 52, and having helically threaded lugs represented by lugs 30, 56, and 62, such lugs being helically threadedly mounted within a helically threaded apertures extending into the left and right ends of cross bar 34. In configuration depicted in FIG. 3, rotatable sleeves 40 and 44 are retained within and rotate within annular channels defined between annularly coffered steps 47 and 43 and the right and left faces of hand stops 50 and 54. Cost economies and materials handling economies are achieved by configuring hand stops 12, 16, 50, and 54 substantially identically along with the helically threaded channels which receive the helically threaded lugs of such hand stops. Attachment of cross bar 34 in the manner depicted in FIG. 3 advantageously alternately configures the hammer curl bar of FIG. 1 for performance of straight bar double bicep curls and double handed overhead pulls.

Figure 6:
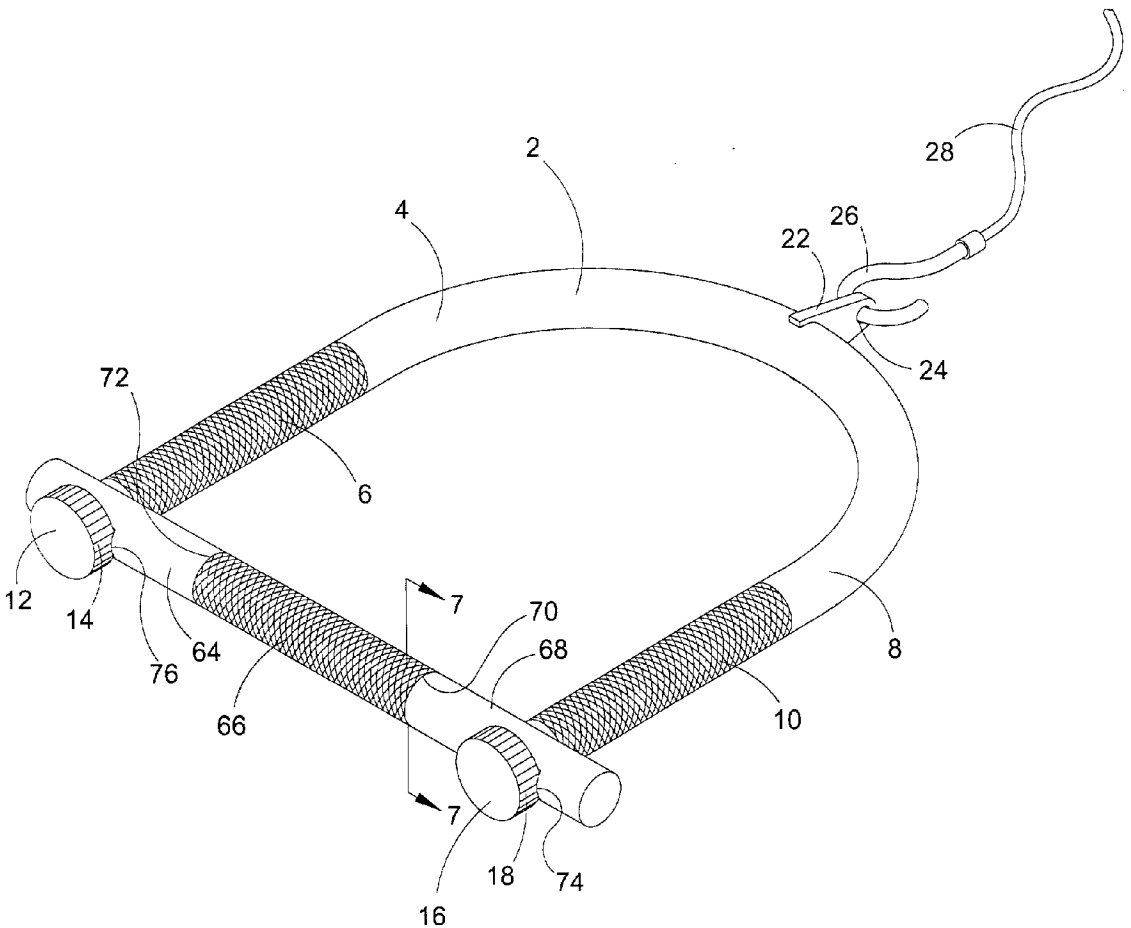
FIG. 6 is a second alternate configuration of the cable pull exercise bar depicted in FIG. 1.
Figure 7:
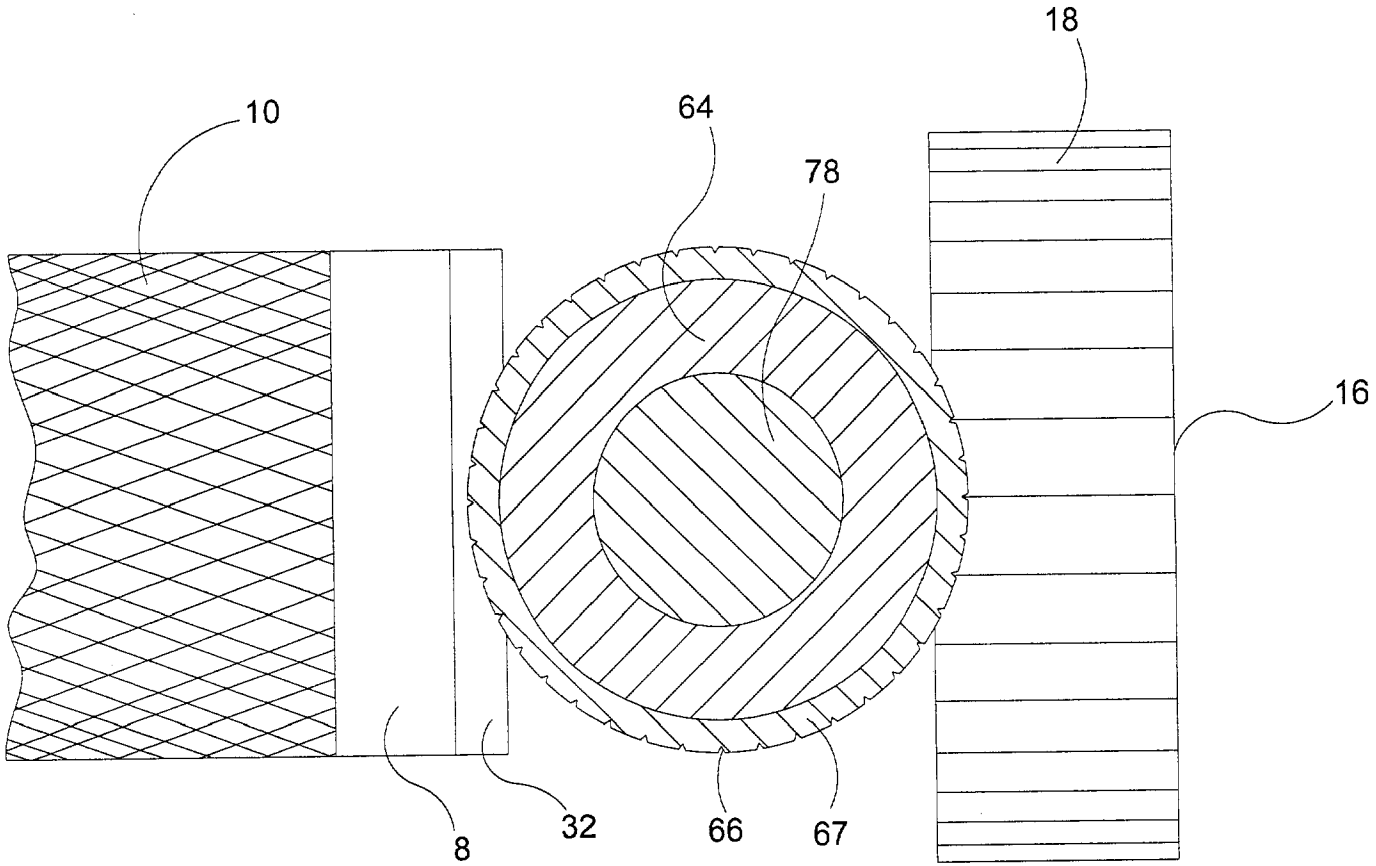
FIG. 7 is a partial sectional view as indicated in FIG. 6.

Referring simultaneously to FIGS. 1, 6, and 7, a differently configured cross bar having a left segment 64 and having a right segment 68, advantageously alternately facilitates single handed bicep curls and overhead pulls. A rotatable sleeve 67 having friction enhancing knurling 66 rotates upon and about the cross bar comprising segments 64 and 68 in a manner similar to, referring further to FIG. 3, that of sleeves 40 and 44 upon cross bar 34. In assembling the cross bar of FIG. 6, segments 64 and 68 are separated from handles 4 and 8 and from hand stops 12 and 16 through counter clockwise rotation and withdrawal of such stops. Either the right end of segment 64 or the left end of segment 68 is annularly coffered, allowing rotatable sleeve 67 to be mounted over the annularly coffered section to rest upon and to be slidably retained by annularly coffered step 70 or 72. The right end of segment 64 or the left end of segment 68 preferably comprises a leftwardly or rightwardly extending helically threaded lug 78 and aperture combination similar to those depicted in FIGS. 2 and 4. Upon rotatably mounting sleeve 67 within the annular channel defined by coffered steps 70 or 72, the assembled cross bar is attached to the base ends of handles 4 and 8 in a manner substantially identical to the attachment steps discussed above with respect to cross bar 34 in FIG. 3. Referring to FIG. 6, hand stops 12 and 16 securely seat within lands 76 and 74. For economy in materials acquisition and handling, rotatable sleeve 67 is preferably configured substantially identically with, referring to FIG. 3, sleeves 40 and 44.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A cable pull exercise bar comprising:

(a) a hammer curl handle pair, each handle among said pair having a base end and having a pulling end, said handles defining a head clearance space, said space opening at the base ends;

(b) a cross beam spanning between and rigidly interconnecting the pulling ends; and, (c) a cable pull attaching means fixedly attached to the cross beam; the cable pull attaching means comprising a hook eye, and each handle having a knurled or ridged hand grip surface; and further comprising a first pair of slide stops and first stop attaching means interconnecting the first pair of slide stops and the base ends of the handles; the first stop attaching means comprising first helically threaded lug and aperture combinations; and further comprising a cross bar having left and right end, the first stop attaching means further interconnecting the cross bar and the handles.

2. The cable pull exercise bar of claim 1 further comprising a second pair of slide stops and second stop attaching means interconnecting the second pair of slide stops and the left and right ends of the cross bar.

3. The cable pull exercise bar of claim 2 wherein the second stop attaching means comprise second helically threaded lug and aperture combinations.

4. The cable pull exercise bar of claim 3 further comprising left and right hand grip sleeves mounted rotatably over the left and right ends of the cross bar, the second pair of slide stops retaining said sleeves.

5. The cable pull exercise bar of claim 4 wherein the second pair of slide stops is configured substantially identically with the first pair of slide stops, and wherein the second helically threaded lug and aperture combinations are configured substantially identically with the first helically threaded lug and aperture combinations.

6. The cable pull exercise bar of claim 5 wherein the left and right ends of the cross bar are annularly coffered, the annular coffers forming, in combination with the second pair of slide stops, left and right sleeve receiving channels.

7. The cable pull exercise bar of claim 6 wherein the left and right hand grip sleeves have knurled or ridged surfaces.

8. The cable pull exercise bar of claim 1 wherein the cross bar comprises left and right segments, and further comprising segment attaching means and a central hand grip sleeve, the segment attaching means interconnecting the left and right segments, the central hand grip sleeve being mounted rotatably over the cross bar.

9. The cable pull exercise bar of claim 8 wherein the left and right cross bar segments respectively have right and left ends and wherein the right end of the left segment is annularly coffered or the left end of the right segment is annularly coffered, said annular coffer forming, in combination with the left end of the right segment or in combination with the right end of the left segment, a central sleeve receiving channel.

10. The cable pull exercise bar of claim 9 wherein the segment attaching means comprises a second helically threaded lug and aperture combination.

11. The cable pull exercise bar of claim 10 wherein the second helically threaded lug and aperture combination is configured substantially identically with the lugs and apertures among the first helically threaded lug and aperture combinations.

12. The cable pull exercise bar of claim 11 wherein the central hand grip sleeve has a knurled or ridged surface.

* * * * *